US006739773B2

(12) United States Patent
Spano

(10) Patent No.: US 6,739,773 B2
(45) Date of Patent: May 25, 2004

(54) THERMAL PRINTING A TWO-COLOR SALES RECEIPT

(75) Inventor: Steven Spano, Ithaca, NY (US)

(73) Assignee: Axiohm Transaction Solutions, Inc., Ithaca, NY (US)

( * ) Notice: Subject to any disclaimer, the term of this patent is extended or adjusted under 35 U.S.C. 154(b) by 208 days.

(21) Appl. No.: 09/747,443

(22) Filed: Dec. 26, 2000

(65) Prior Publication Data

US 2002/0185029 A1 Dec. 12, 2002

(51) Int. Cl.[7] ..... B41J 11/44

(52) U.S. Cl. ..... 400/120.01; 400/76; 400/70; 400/61

(58) Field of Search ..... 400/120.01, 61, 400/70, 76

(56) References Cited

U.S. PATENT DOCUMENTS 5,503,483 A * 4/1996 Petteruti et al. ..... 400/88
5,850,217 A * 12/1998 Cole ..... 345/700
5,947,619 A * 9/1999 Kurashina et al. ..... 400/615.2
6,062,750 A * 5/2000 Ueno et al. ..... 400/615.2

FOREIGN PATENT DOCUMENTS

JP 09330473 A * 12/1997 ..... G07G/1/06

* cited by examiner

*Primary Examiner*—Charles H Nolan, Jr.
(74) *Attorney, Agent, or Firm*—George R. McGuire; Bond, Schoeneck & King, PLLC

(57) ABSTRACT

Methods of enhancing the appearance of, and safeguarding, sales receipts. The methods provide sales receipts with watermarks, strike-throughs, and circles-about-an-item. These added functions can be accomplished in real time. Some of them can be printed in distinguishing colors.

14 Claims, 5 Drawing Sheets

~~Regular $3.95~~

Now $2.95

~~Regular $3.95~~ Now $2.95

You Saved $3.25

THERMAL PRINTING A TWO-COLOR SALES RECEIPT

FIELD OF THE INVENTION

The present invention relates to printing sales receipts and, more particularly, to methods of enhancing the appearance of, and safeguarding, sales receipts by inclusion of watermarks, strike-throughs, and circles-about-an-item, all of which can be printed in two colors and in real time.

BACKGROUND OF THE INVENTION

Printing sales receipts in two colors is well known in the art. The two colors, such as red and black, draw attention to and emphasize certain important items on the receipt, such as sales tax, discounts, and non-taxable items.

This invention reflects the discovery that the appearance of sales receipts can be improved by adding a strike-through function, a watermark, and a circle-about-an-item. In addition to enhancing the appearance of the receipt, these added functions also improve the security of the receipt against erasures, forgeries, and receipt duplications. For example, the strike-through function can be used to void certain items and to emphasize a discounted item. The watermark function is intended to embed a design, logo, or graphic into the receipt paper. The embedded design is useful in thwarting counterfeit receipts, distinguishing between original and duplicate receipts, and generally discouraging attempts to commit fraud. The circle-about-an-item function is extremely effective in emphasizing certain items.

SUMMARY OF THE INVENTION

In accordance with the present invention, there is provided methods of enhancing the appearance of, and safeguarding, sales receipts. The methods of this invention provide sales receipts with watermarks, strike-throughs and circles-about-an-item. These added functions can be accomplished in real time; some of them can be printed in differentiating colors. The strike-through function is obtained by selectively adding a dot row to the center of the font cell. The strike-through has application in voiding purchased items, and in emphasizing the old price in a discounted item. The watermark function embeds a predefined logo or graphic into the receipt paper, in order to discourage fraud and counterfeiting. The watermark process prints the watermark in red, which cannot be copied on black print only copiers. The graphic is filtered to provide a faded background image. The method of adding a circle to surround a printed item can be selected to highlight specific text. The circle can be partially broken or completely closed. The method uses a set of four command parameters.

It is an object of this invention to provide methods of enhancing and safeguarding printed sales receipts.

It is another object of the invention to provide methods of adding strike-throughs, watermarks, and circles-about-an-item for two-color sales receipts.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features three methods of enhancing the appearance of, and safeguarding, sales receipts. The methods of this invention provide sales receipts with watermarks, strike-throughs, and circles-about-an-item. These added functions can be accomplished in real time; some of them can be printed in distinguishing colors.

Figures 1, 2:
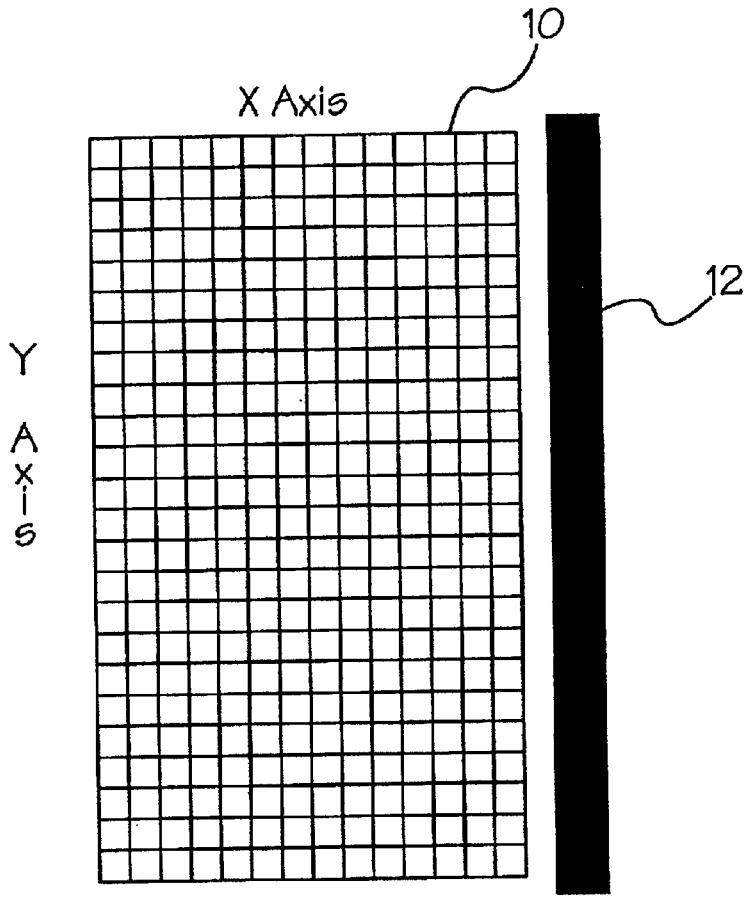
FIG. 1 illustrates a plan view of a typical font cell being modified to provide a strike-through function.
FIG. 2 depicts a plan view of a strike-through being used to emphasize the new sale price of a sales item.

Now referring to FIG. 1, a typical font cell 10 for standard ASCII text is shown. The font cell 10 was obtained with a 203 dpi thermal printer. The font cell 10 is thirteen dots wide by twenty-four dots high.

In order to achieve a strike-through, a command is given by the user through the print keyboard (not shown), that selectively adds a dot row 12 to the center of the font cell 10. The additional dot row 12 comprises the same color as does its destination character or characters. The strike-through function is illustrated in FIG. 2. It is often used to void purchased items, sales prices, etc. and to highlight discount pricing.

Figure 3:
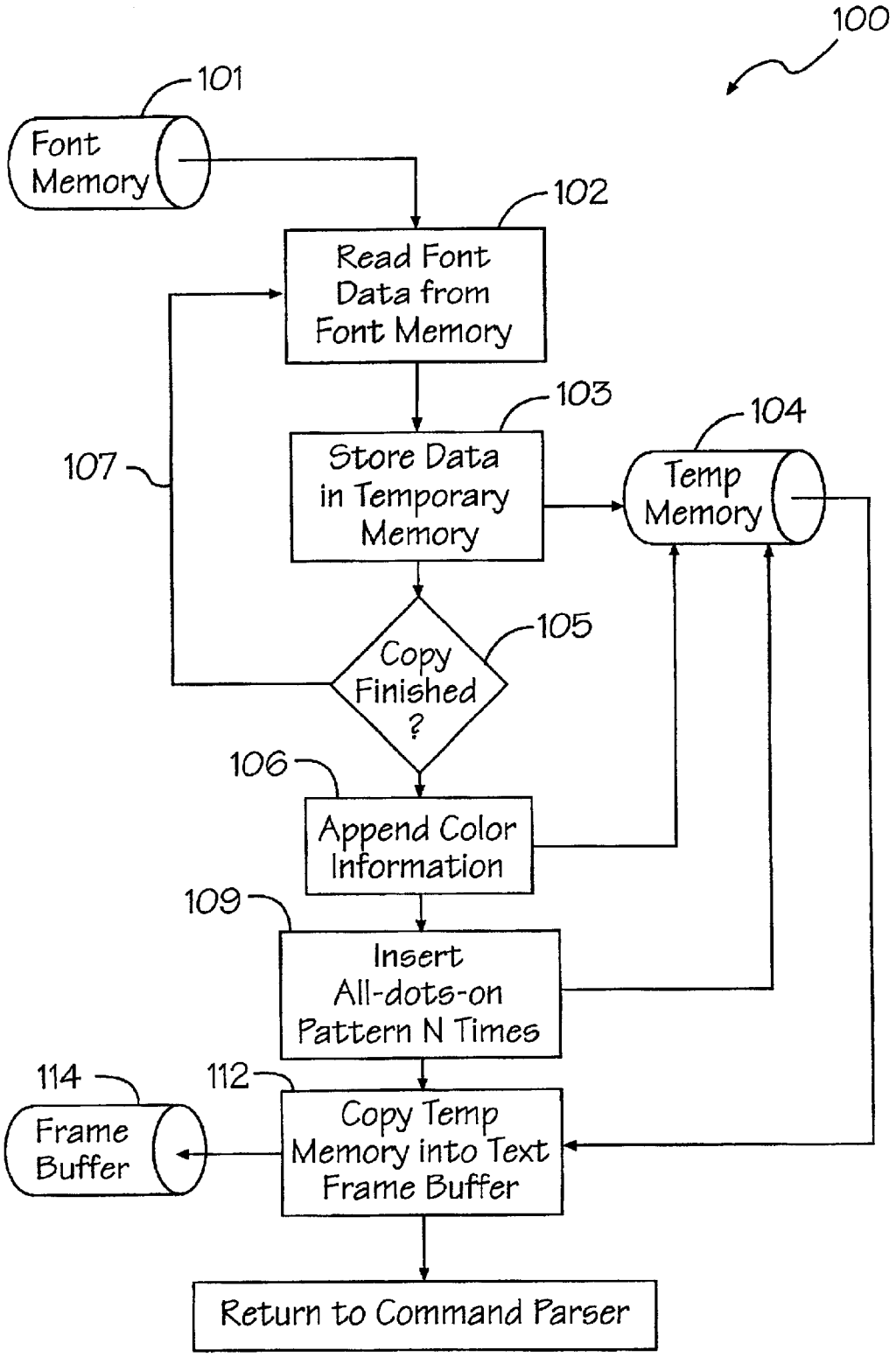
FIG. 3 is a flow chart for the method of providing a strike-through for a sales receipt.

Referring to FIG. 3, a flow chart 100 depicts the method used to obtain the strike-through, shown in FIG. 2. From font memory 101, font data is read, step 102. The data is then stored in temporary memory 104, step 103. If the data has been properly extracted, step 105, then color information is added, step 106. If the data has not been properly extracted, step 105, then block 102 is re-entered via feedback loop 107.

Having properly appended the color information, step 106, this is stored in temporary memory 104. After the color information has been appended, the dots used for the strike-through function are inserted, step 109. This information is also sent to temporary memory 104. The temporary information is then copied into a text frame buffer 114, step 112. The program sequence then returns to the command parser.

The watermark function is a real-time operation that is intended to embed a logo or design into the sales receipt, in order to prevent fraud by fabricating a counterfeit or erroneous receipt. The watermark function combines arbitrary text (i.e., receipts with a predefined logo or graphic). The logo or graphic is filtered in order to achieve a faded effect. The faded logo is then merged, in real time, with the text stream. The result is a receipt with a faded image in the background. The graphic is printed in red only. The red watermark discourages counterfeiting, because the graphic is difficult to photocopy.

Figure 4:
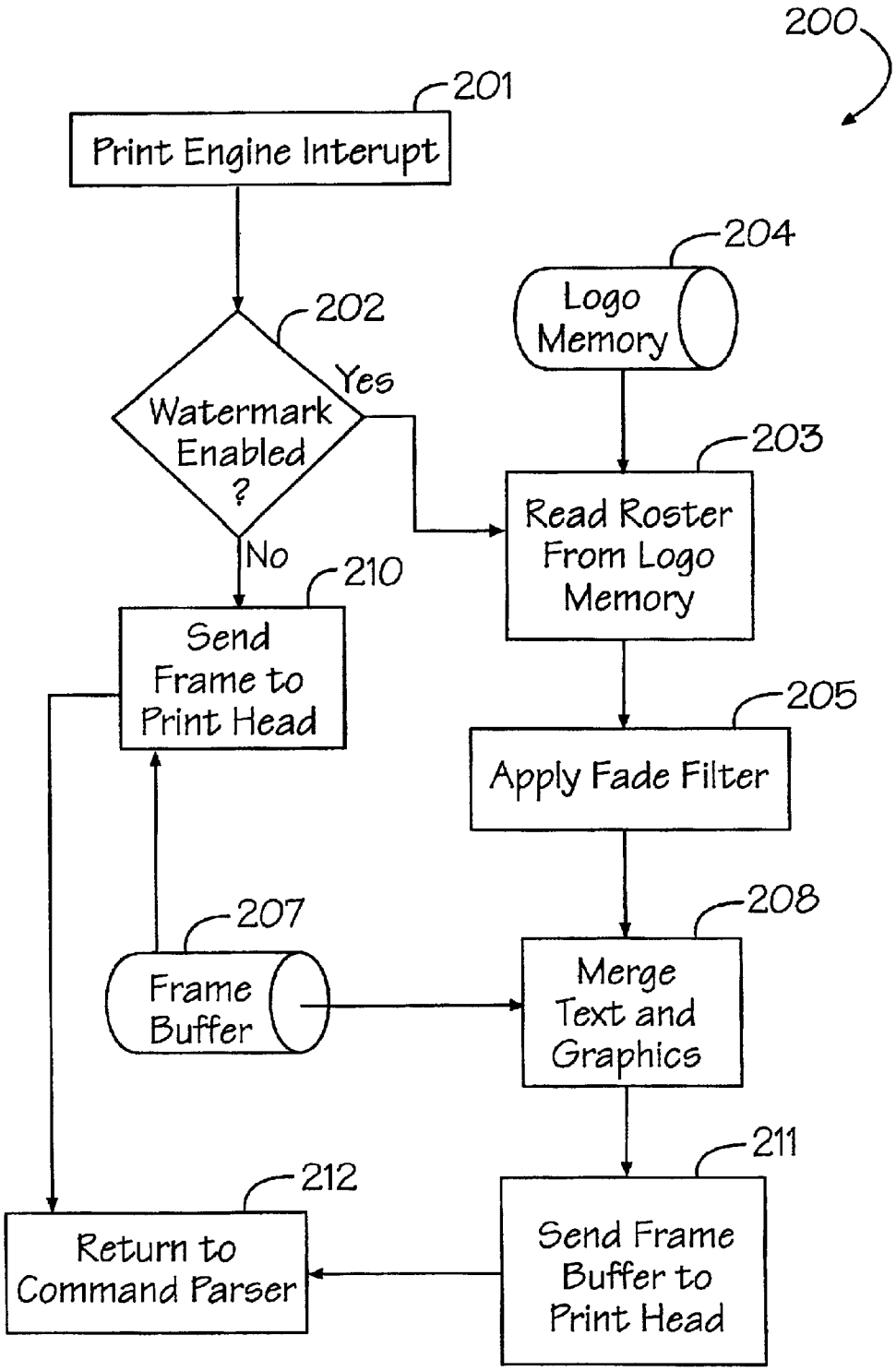
FIG. 4 illustrates a flow chart diagram for the process of generating a watermark on a sales receipt.

Referring to FIG. 4, a block diagram is shown of a flow chart 200, showing the method of achieving a watermark when printing a sales receipt. After receipt of a print engine interrupt signal 201, the system determines whether the watermark is enabled, step 202. When the watermark is enabled, a raster is read from logo memory 204, step 203. A fade filter is then applied, step 205, and the graphic is then merged with text, step 208, which is secured from a frame buffer 207. The text can be sent to the print head either directly, step 210, or from the merged graphic, step 211. The program sequence then returns to the command parser, step 212.

Figure 5:
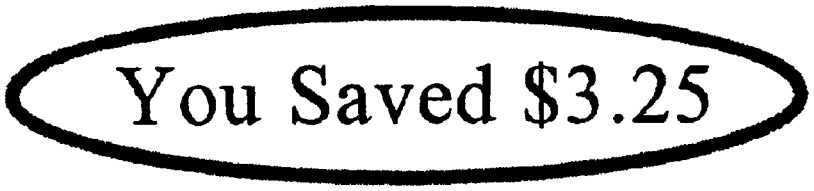
FIG. 5 depicts a plan view of printed sales receipt items featuring the circle-about-an-item function, in accordance with this invention.
Figure 5:
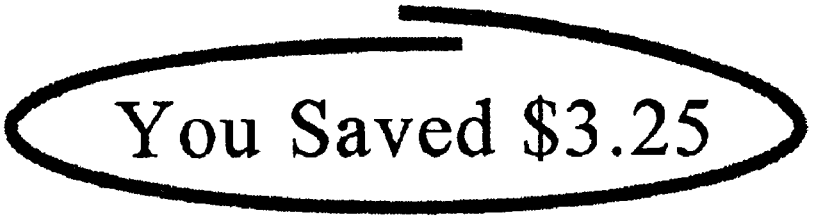
Figure 5:
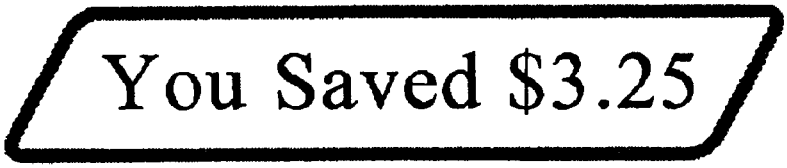

The circle-about-an-item command is designed to allow the user to circle one to four lines of ASCII text at any location on the receipt. The circle is intended to provide an additional method for highlighting or emphasizing some section of the receipt. The command can be selected to create a closed or partially broken circle or any other regular or irregular surrounding shape, as shown in FIG. 5. The command uses a set of four command parameters with two parameters used to initiate the sequence. The user, therefore, must transmit six, one byte data segments. A typical sequence is illustrated below, in hexadecimal form:

$1B_h$ $XX_h$ $Field1_h$ Field $2_h$ Field $3_h$ Field $4_h$

As aforementioned, the command is composed of six segments, of which the first segment $1B_h$ is an industry standard character (ESC). This character designates a command sequence. The second segment $XX_h$ refers to an undefined command code. This code is used to signify the real-time circle sequence. The last four parameters ($Field1_h$ through $Field4_h$) are used as coordinate and image selection controls. Table 1, shown below, illustrates the use of these fields.

TABLE 1

| | |
|---|---|
| Field 1 | Lefthand Center/Loci. Number is based on the maximum allowable characters per line. |
| Field 2 | Righthand Center/Loci. Number is based on the maximum allowable characters per line. |
| Field 3 | Y axis dimension. This is limited to a range of 1 through 4. The field specifies the number of lines that the circle will encompass. |
| Field 4 | Equation/Image selection (i.e., Closed circle, broken circle, other shape, etc.) |

Figure 6:
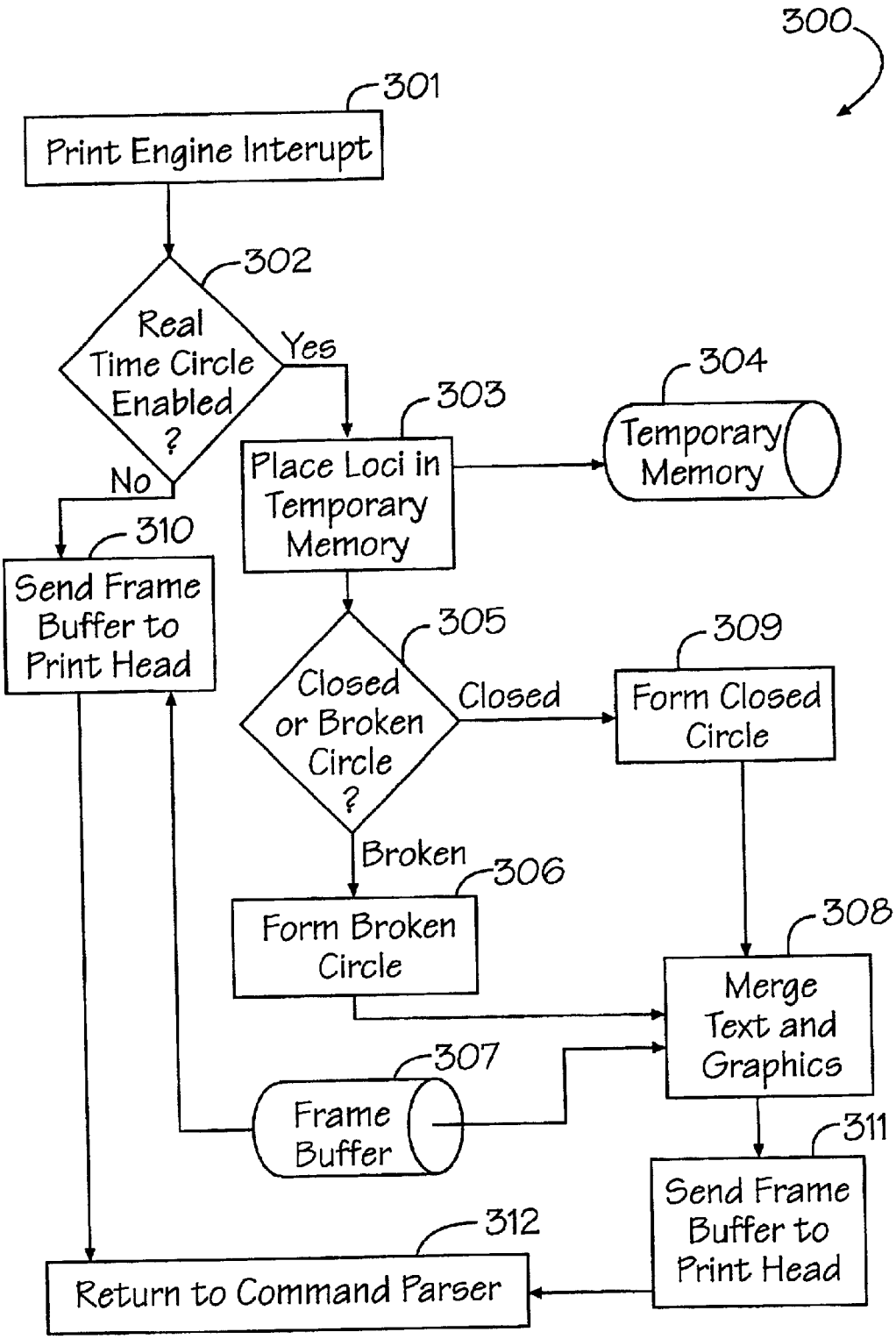
FIG. 6 is a flow chart of the method of providing the circle-about-an-item function as shown in FIG. 5.

Referring to FIG. 6, a flow chart 300 is shown for providing a circle about a number of lines of text in a sales receipt. A print engine interrupt signal 301 is received. The system determines if the circle is enabled, step 302. When the circle is enabled, a loci is placed in temporary memory 304, step 303. Next, a decision is made as to whether the circle is to be closed or broken, step 305. If the broken circle is formed, step 306, it is merged with text, step 308, which is secured from the frame buffer 307. If a closed circle is formed, step 309, it is merged with text, step 308, which is likewise secured from the frame buffer 307. The text can be sent to the print head either directly, step 310, or from the merged text and circle image, step 311. The program sequence then returns to the command parser, step 312.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method of printing at least a portion of a sales receipt with a graphic, the steps comprising:

a) placing graphical information in memory;

b) forming a graphic using said graphical information;

c) merging said graphic with text in real time; and d) printing said merged graphic with text upon a sales receipt.

2. The method of printing a graphic upon a sales receipt in accordance with claim 1, wherein a circle-about an-item is printed about up to four lines of text.

3. The method of printing a graphic upon a sales receipt in accordance with claim 2, wherein said circle-about-an-item is printed with a broken circle.

4. The method of printing a graphic upon a sales receipt in accordance with claim 2, wherein said circle-about-an-item is printed with a closed circle.

5. The method of printing a graphic upon a sales receipt in accordance with claim 1, wherein a watermark is printed in red ink.

6. The method of printing a graphic upon a sales receipt in accordance with claim 1, wherein a watermark is printed, said method further comprising the step of:

e) applying a fade filter to said graphic.

7. A method of printing at least a portion of a sales receipt with a strike-through, the steps comprising:

a) obtaining font information from memory;

b) using a font cell from said font information, and selectively adding a dot row to an intermediate portion thereof;

c) selecting a dot row axis;

d) repeating steps (a) through (c) to generate a strike-through; and e) printing said strike-through upon a sales receipt.

8. A method of enhancing at least a portion of a sales receipt with a graphic, the steps comprising:

a) placing graphical information in memory;

b) forming a graphic using said graphical information;

c) merging said graphic with text in real time; and d) printing said merged graphic with text upon a sales receipt.

9. The method of printing a graphic upon a sales receipt in accordance with claim 8, wherein a circle-about-an-item is printed about up to four lines of text.

10. The method of printing a graphic upon a sales receipt in accordance with claim 9, wherein said circle-about-an-item is printed with a broken circle.

11. The method of printing a graphic upon a sales receipt in accordance with claim 9, wherein said circle-about-an-item is printed with a closed circle.

12. The method of printing a graphic upon a sales receipt in accordance with claim 8, wherein a watermark is printed in red ink.

13. The method of printing a graphic upon a sales receipt in accordance with claim 8, wherein a watermark is printed, said method further comprising the step of:

e) applying a fade filter to said graphic.

14. The method of printing a graphic upon a sales receipt in accordance with claim 8, wherein a watermark comprises a logo.

* * * * *

UNITED STATES PATENT AND TRADEMARK OFFICE

CERTIFICATE OF CORRECTION

PATENT NO. : 6,739,773 B2
APPLICATION NO. : 09/747443
DATED : May 25, 2004
INVENTOR(S) : Steven Spano It is certified that error appears in the above-identified patent and that said Letters Patent is hereby corrected as shown below:

In The Claims:

Col. 4, Claim 2, line 8, please insert a dash -- - -- between “about” and “an”.

Signed and Sealed this

Twenty-second Day of May, 2007

JON W. DUDAS
*Director of the United States Patent and Trademark Office*

US006739773C1

(12) EX PARTE REEXAMINATION CERTIFICATE (10492nd)

United States Patent

Spano

(10) Number: US 6,739,773 C1

(45) Certificate Issued: Jan. 30, 2015

(54) THERMAL PRINTING A TWO-COLOR SALES RECEIPT

(75) Inventor: Steven Spano, Ithaca, NY (US)

(73) Assignee: Pine Street Capital Partners IL, LP, Albany, NY (US)

Reexamination Request:
No. 90/012,889, Jun. 12, 2013

Reexamination Certificate for:

| | |
|---|---|
| Patent No.: | **6,739,773** |
| Issued: | **May 25, 2004** |
| Appl. No.: | **09/747,443** |
| Filed: | **Dec. 26, 2000** |

Certificate of Correction issued May 22, 2007

(51) Int. Cl.
*G07G 5/00* (2006.01)

(52) U.S. Cl.
USPC ..... 400/120.01; 400/61; 400/70; 400/76

(58) Field of Classification Search
None
See application file for complete search history.

(56) References Cited

To view the complete listing of prior art documents cited during the proceeding for Reexamination Control Number 90/012,889, please refer to the USPTO's public Patent Application Information Retrieval (PAIR) system under the Display References tab.

*Primary Examiner* — Stephen J Ralis

(57) ABSTRACT

Methods of enhancing the appearance of, and safeguarding, sales receipts. The methods provide sales receipts with watermarks, strike-throughs, and circles-about-an-item. These added functions can be accomplished in real time. Some of them can be printed in distinguishing colors.

~~Regular $3.95~~ Now $2.95

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 7 is cancelled.

Claims 1-4 and 8-11 are determined to be patentable as amended.

Claims 5, 6 and 12-14, dependent on an amended claim, are determined to be patentable.

New claims 15-18 are added and determined to be patentable.

1. A method of printing at least a portion of a sales receipt with a graphic, the steps comprising:

a) placing graphical information*, wherein said graphical information comprises instructions for forming at least one of a partially broken circle or a completely closed circle,* in memory;

b) forming a graphic*, wherein said graphic is a partially broken circle, or a completely closed circle,* using said graphical information;

c) merging said graphic with text in real time; and d) printing said merged graphic with text upon a sales receipt.

2. The method of printing a graphic upon a sales receipt in accordance with claim 1, wherein [a] *said partially broken or said completely closed* circle-about-an-item is printed about up to four lines of text.

3. The method of printing a graphic upon a sales receipt in accordance with claim 2, wherein said *partially broken* circle-about-an-item is printed [with a broken circle].

4. The method of printing a graphic upon a sales receipt in accordance with claim 2, wherein said *completely closed* circle-about-an-item is printed [with a closed circle].

8. A method of enhancing at least a portion of a sales receipt with a graphic, the steps comprising:

a) placing graphical information*, wherein said graphical information comprises instructions for forming at least one of a partially broken circle or a completely closed circle,* in memory;

b) forming a graphic*, wherein said graphic is a partially broken circle, or a completely closed circle,* using said graphical information;

c) merging said graphic with text in real time; and d) printing said merged graphic with text upon a sales receipt.

9. The method of printing a graphic upon a sales receipt in accordance with claim 8, wherein [a] *said partially broken or said completely closed* circle-about-an-item is printed about up to four lines of text.

10. The method of printing a graphic upon a sales receipt in accordance with claim 9, wherein said *partially broken* circle-about-an-item is printed [with a broken circle].

11. The method of printing a graphic upon a sales receipt in accordance with claim 9, wherein said *completely closed* circle-about-an-item is printed [with a closed circle].

*15. The method of claim 1, wherein said instructions further comprises loci of a partially broken circle.*

*16. The method of claim 1, wherein said instructions further comprises loci of a completely closed circle.*

*17. The method of claim 8, wherein said instructions further comprises loci of a partially broken circle.*

*18. The method of claim 8, wherein said instructions further comprises loci of a completely closed circle.*

* * * * *